United States Patent [19]

El Gammal

[11] 4,199,351

[45] Apr. 22, 1980

[54] TREATMENT AGENTS FOR MOLTEN METALS

[75] Inventor: Tarek El Gammal, Aachen, Fed. Rep. of Germany

[73] Assignee: Foseco Trading A.G., Chur, Switzerland

[21] Appl. No.: 923,279

[22] Filed: Jul. 10, 1978

[30] Foreign Application Priority Data

Jul. 14, 1977 [DE] Fed. Rep. of Germany ..... 2731857

[51] Int. Cl.[2] ..... C21C 7/00; C22C 33/08

[52] U.S. Cl. ..... 75/53; 75/58; 75/130 R; 75/130 A; 75/130 AB

[58] Field of Search ..... 75/53, 58, 130 R, 130 A, 75/130 AB

[56] References Cited

U.S. PATENT DOCUMENTS

| | | | |
|---|---|---|---|
| 3,801,303 | 4/1974 | Kotler | 75/58 |
| 3,953,198 | 4/1976 | Easwaran | 75/53 |
| 4,040,818 | 8/1977 | Clegg | 75/53 |

*Primary Examiner*—P. D. Rosenberg

*Attorney, Agent, or Firm*—Caesar, Rivise, Bernstein & Cohen, Ltd.

[57] ABSTRACT

The invention provides a body for introducing a treatment agent into a metal melt e.g. a ferrous metal melt, the body comprising a volatile treatment agent e.g. magnesium dispersed in a matrix comprising refractory, heat-insulating material, a particulate material of high thermal conductivity and a binder. The body enables metal to be treated quickly, reliably and safely.

10 Claims, 2 Drawing Figures

TREATMENT AGENTS FOR MOLTEN METALS

Figure 1:
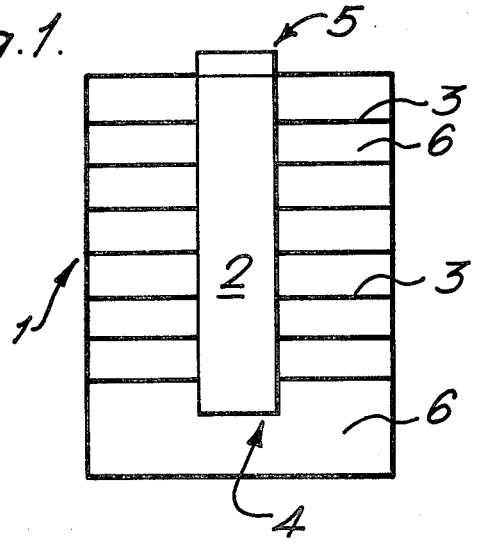

This invention concerns treatment agents for molten metals.

For the treatment of molten metals with volatile treatment agents, i.e. having relatively low melting and boiling points, it is known to immerse a body comprising the agent in the metal. For example, for treating molten ferrous metals with magnesium it is known to use briquettes comprising powdered magnesium together with other metals or alloys e.g. iron, silicon or ferrous alloys. It is also known to use bodies comprising coke or sponge-iron impregnated with magnesium. Furthermore, it is known to use bodies comprising refractory, heat-insulating matter in which are embedded magnesium particles. See copending Application Ser. No. 732,577, the entire disclosure of which is incorporated herein by reference.

The briquettes and impregnated bodies are of high thermal conductivity and are soluble in ferrous metal melts. Accordingly, at the very high temperatures e.g. 1450° C. or higher prevailing in use magnesium vapour is formed very rapidly and can cause the briquette or other body to break, e.g. with explosive force, and splashing of the melt may also result. However, where magnesium particles are embedded in a body comprising refractory, heat-insulating matter, the insulating effect may be such that the magnesium is released undesirably slowly, especially from the inner part of the body and especially in the case of thick bodies, and the body may have to be withdrawn when it still contains a substantial proportion of magnesium.

An object behind the present invention was to minimize the above disadvantages and, in accordance with the invention, these advantages are minimized by a body for introducing a treatment agent into a metal melt which body contains a volatile treatment agent dispersed in a matrix comprising refractory, heat-insulating material, a particulate material of high thermal conductivity and a binder.

The volatile treatment agent preferably comprises an alkali metal or, more preferably, an alkaline earth metal. The treatment agent may consist of one of these metals alone or it may be an alloy or mixture of at least two such metals or an alloy or mixture of at least one such metal with at least one other element e.g. aluminum, silicon, nickel, iron, carbon or maganese. The most preferred treatment agent is magnesium (and alloys and mixtures thereof).

The preferred treatment agents are suitable for treatment, especially deoxidation and desulphurisation, of ferrous metals e.g. steel and cast iron and the preferred treatment agents described above are useful for such purposes.

The treatment agent is preferably in fine particulate, e.g. powder, form and preferably forms 1 to 70%, more preferably 20 to 50% especially 30 to 50%, by weight of the body.

The refractory, heat-insulating material preferably comprises at least one particulate refractory material such as magnesia, calcium oxide, calcined dolomite, alumina, silica, carbides and silica sand and other sands. Preferably the refractory material is at least in part powdery or granular but some, or even all, of it may be fibrous e.g. aluminosilicate fibres. The body preferably contains 20 to 50%, more preferably 25 to 45%, by weight of powdery or granular refractory, heat-insulating material. The preferred such material is magnesia e.g. calcined magnesite. If refractory heat-insulating fibres are present, the amount preferably does not exceed 10% by weight.

The particulate material of high thermal conductivity is preferably of low volatility and metals, especially iron, steel and ferrous alloys, are preferred. Examples are wire, chips, grains, powder or particulate processing wastes of iron or steel and, most preferably, finely divided sponge iron, e.g. in powder form, and steel wool. Mixtures of such materials may be used.

The high thermal conductivity material may form 1 to 60% by weight of the body, preferably 10 to 30%.

The binder may be organic, e.g. natural resins, synthetic resins, such as phenolic resins, and starch, or inorganic, e.g. Portland cement and blast-furnace cement, and two or more binders of the same or different types may be used. The amount of binder is preferably from 3 to 6% by weight and synthetic resins binders, especially phenolic resin binders, are preferred.

In addition to the constituents mentioned above the matrix of the body may contain organic fibres e.g. waste paper fibres, paper pulp, wood pulp, especially mechanical wood pulp, and other cellulosic fibres. Such fibres may assist forming the bodies but are preferably not present in an amount of more than 3% by weight. Furthermore, the matrix may contain inorganic fibres that are neither refractory nor of high thermal conductivity e.g. glass wool and rock wool. The presence of fibres in the matrix may be advantageous in that it may strengthen the body e.g. by forming a reinforcing reticular structure and the fibre may also impart a degree of porosity that assists release of the treatment agent from the body.

The matrix of the body may also include pore-forming materials, especially organic ones, of a generally granular nature e.g. sawdust and finely crushed or ground organic substances.

Controlled conduction of heat into the body may be further effected by providing the constituents of the body in and around a pre-formed skeleton of material of high thermal conductivity e.g. a metal such as iron or steel or carbon e.g. graphite. The skeleton preferably comprises a central core e.g. in the form of a rod and extending laterally from this a plurality of plates e.g. in the form of discs centered on the core. The skeleton serves to strengthen the body in addition to the conductivity effect and the core may extend to or beyond one end of the body and provide a means of attaching the body to a device for plunging it into the molten metal.

The treatment time is usually very short and, in view of this, even if the body contains a metal such as iron or steel as the particulate high conductivity matter and has a skeleton of such a metal, there is no likelihood of any substantial melting of such metals during use of the device to treat metals such as iron and steel.

The bodies are preferably made by forming a suspension of the ingredients, optionally together with a surfactant and/or other suspending agent, in water, dewatering the suspension in a former and drying the formed shape. For example, the suspension may be cast as a plate in the top and bottom part of a sieve and the water drained off by means of vacuum. The dewatered plates may then be dried in an oven at 180° C. and, if desired, then cut to any other shape desired in use.

The invention is further described with reference to the following Examples in which all percentages are by weight.

EXAMPLE 1 (Comparative)

The following ingredients were used in the manner described above to form two discs, each being 4 inches in diameter and 1 inch thick and each weighing 400 g:

| | |
|---|---|
| calcined magnesite | 62% |
| magnesium | 30% |
| phenolic resin binder | 4% |
| paper fibres | 2% |
| aluminosilicate fibres | 2% |

The discs were attached to a refractory rod and immersed in molten steel at about 1580° C. in a ladle. The discs were withdrawn by the rod after 12 minutes and at this stage still contained some magnesium, burning of which was observed.

EXAMPLE 2

Two discs were formed as in Example 1 but using the following ingredients:

| | |
|---|---|
| calcined magnesite | 42% |
| magnesium | 30% |
| finely divided sponge iron | 20% |
| phenolic resin binder | 4% |
| paper fibres | 2% |
| aluminosilicate fibres | 2% |

The discs were of the same size as in Example 1 and were tested in the same way. In this case the discs were withdrawn after 4.5 minutes and at this stage were substantially free of magnesium, no burning of magnesium being observed.

EXAMPLE 3

Two discs were formed as in Example 1 but using the following ingredients:

| | |
|---|---|
| calcined magnesite | 42% |
| magnesium | 30% |
| steel wool | 20% |
| phenolic resin binder | 4% |
| paper fibres | 2% |
| aluminosilicate fibres | 2% |

The discs were of the same size as in Example 1 and were tested in the same way. In this case the discs were withdrawn after 4 minutes and at this stage were substantially free of magnesium, no burning of magnesium being observed.

EXAMPLE 4

Two discs were made as in Example 1 but using the following ingredients:

| | |
|---|---|
| Calcine magnesite | 37% |
| magnesium | 30% |
| finely divided sponge iron | 15% |
| steel wool | 10% |
| phenolic resin binder | 4% |
| paper fibres | 2% |
| aluminosilicate fibres | 2% |

The discs were of the same size as in Example 1 and were tested in the same way. In this case the discs were withdrawn after 4 minutes and at this stage were substantially free of magnesium, no burning of magnesium being observed.

Figure 2:
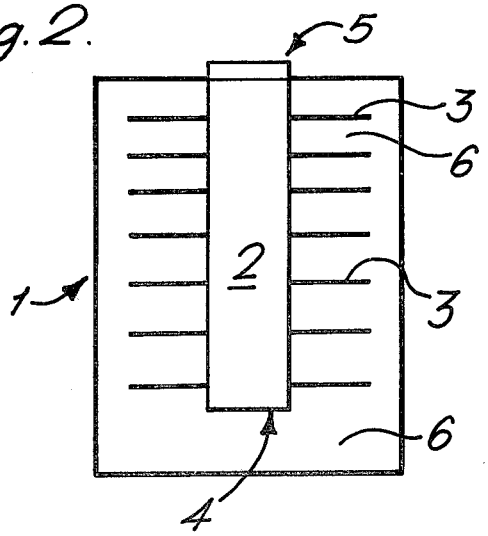

The invention is further described with reference to the drawings in which:

FIG. 1 is a vertical section through a body, having a skeleton, in accordance with the invention and FIG. 2 is a vertical section through a modification and has a pre-formed skeleton of material of high thermal conductivity e.g. steel, the skeleton having a central rod-like core 2, and, attached to the core, discs 3. The core extends from a position 4 near the lower end of the body to a position 5 above the upper end of the body and at this position the body may be connected to a device for plunging the body into the molten metal e.g. steel to be treated.

In the case of FIG. 1 and discs 3 extend to the sides of the body whereas in FIG. 2 the discs stop short of the sides of the body.

In each case in and around the skeleton there is a composition 6 comprising a particulate volatile treatment agent dispersed, in a matrix comprising refractory, heat-insulating material, a particulate material of high thermal conductivity and a binder e.g. a resin binder.

Use of the body, e.g. by immersion, for treatment of molten metals, e.g. steel or individual metals or mixtures thereof forms a part of the invention.

Without further elaboration the foregoing will so fully illustrate my invention that others may, by apply current or future knowledge, readily adapt the same for use under various conditions of service.

What is claimed as the invention is:

1. A body for introducing a treatment agent into a metal melt, said body comprising a volatile treatment agent dispersed in a matrix comprising refractory, heat-insulating material, a particulate metallic material of high thermal conductivity and a binder.

2. A body according to claim 1 in which the treatment agent is selected from the group consisting of alkaline earth metals and mixtures and alloys containing at least one alkaline earth metal.

3. A body according to claim 1 in which the treatment agent is magnesium.

4. A body according to claim 1 in which the treatment agent forms 20 to 50% by weight of the total weight of the treatment agent and the matrix.

5. A body according to claim 1 in which the particulate material of high thermal conductivity is selected from the group consisting of steel wool, finely divided sponge iron and mixtures thereof.

6. A body according to claim 1 in which the particulate material of high thermal conductivity forms 10 to 30% by weight of the total weight of the treatment agent and the matrix.

7. A method of treating a molten metal comprising immersing in said metal a body comprising a volatile treatment agent dispersed in a matrix comprising refractory, heat-insulating material, a particulate metallic material of high thermal conductivity and a binder.

8. A method according to claim 7 in which the molten metal is a ferrous metal.

9. A body according to claim 1 further including organic fibers.

10. A body of claim 9 wherein the organic fibers are paper fibers.

* * * * *